United States Patent [19]

Grover

[11] Patent Number: 4,925,396

[45] Date of Patent: May 15, 1990

[54] LATCHING MECHANISM FOR ELECTRICAL PLUGS

[76] Inventor: Dennis L. Grover, 706 E. Greenwood, Springfield, Mo. 65807

[21] Appl. No.: 373,506

[22] Filed: Jun. 30, 1989

[51] Int. Cl.[5] ..... H01R 13/639

[52] U.S. Cl. ..... 439/147; 439/346; 439/347

[58] Field of Search ..... 439/345, 346, 347, 135, 439/136, 137, 143, 144, 145, 147, 271, 277, 283

[56] References Cited

U.S. PATENT DOCUMENTS

| | | | |
|---|---|---|---|
| 2,340,822 | 5/1941 | Scott | 439/271 |
| 2,458,153 | 6/1946 | Festge | 439/272 |
| 2,552,061 | 5/1951 | Popp | 439/136 |
| 2,732,531 | 3/1953 | Janowiec | 439/346 |
| 3,710,304 | 1/1973 | Warner et al. | 439/346 |
| 4,085,991 | 4/1978 | Marshall et al. | 439/346 |
| 4,136,919 | 1/1979 | Howard et al. | 439/346 |
| 4,784,611 | 11/1988 | Poulin et al. | 439/346 |

*Primary Examiner*—Eugene F. Desmond
*Assistant Examiner*—Walter G. Hanchuk
*Attorney, Agent, or Firm*—Kokjer, Kircher, Bradley, Wharton, Bowman & Johnson

[57] ABSTRACT

An electrical plug-socket connection in which the socket is provided with sliding latch plates that fit in notches in the plug prongs to latch the prongs in the slots of the socket. Springs urge the latch plates toward their latching positions. Release buttons are diametrically opposite one another on the socket body and may be depressed to release the latch plates through lever arms which slide the latch plates against the spring force to release positions. The latch plates are then disengaged from the notches in the prongs and the prongs may be withdrawn from the slots in the socket. The face of the socket has waterproof gasket and the release buttons are covered by waterproof covers to make the plug-socket water tight.

14 Claims, 1 Drawing Sheet

LATCHING MECHANISM FOR ELECTRICAL PLUGS

BACKGROUND AND SUMMARY OF THE INVENTION

This invention relates generally to electrical plug-socket connections and more particularly to an arrangement for latching a plug and socket together.

A wide variety of electrical appliances, tools and equipment require an electrical connection that is usually made by connecting a plug with a socket which is typically either a wall mounted receptacle or a female socket carried on one end of an electrical extension cord. Particularly when portable electrical equipment or portable power tools are being used, the cord attached to the equipment can pull on the electrical connection hard enough to accidentally pull the plug prongs out of the slots in the socket. This not only removes electrical power from the equipment, but it can also create safety hazards such as when water is present and the disconnected socket falls into a pool of water. Water that enters the area between the mating faces of a plug and socket can also create short circuits and other problems. For example, when firefighters are using extension cords and electrical equipment in the course of fighting a fire, the water that is sprayed onto the fire and the surrounding areas can easily leak between the electrical connectors and create problems that inhibit the effectiveness of the fire fighting operations and can endanger the well being of the fire fighters.

Accordingly, there is a need for an electrical plug and socket connection that is secure enough to resist forces tending to cause disconnection and yet can be quickly and easily disconnected when desired. It is the principal goal of the present invention to meet that need.

More specifically, it is an object of the invention to provide a latching mechanism for latching electrical plug prongs in place in the slots of a mating female socket in order to avoid inadvertent detachment of the plug and socket connection.

Another object of the invention is to provide a plug-socket latching mechanism that may be easily and conveniently unlatched when desired. In this respect, it is an important feature of the invention that the release buttons on the socket body are located at diametrically opposed positions so that they can be simultaneously depressed by the thumb and forefinger of one hand while the other hand remains free to pull the plug away from the socket.

A further object of the invention is to provide a plug-socket latching mechanism of the character described in which the prongs are securely latched automatically upon being inserted into the slots of the socket.

Still another object of the invention is to provide a plug-socket latching mechanism of the character described which makes use of a standard plug and requires only minimal modification of the plug prongs. In the preferred embodiment of the invention, the prongs need only be notched and bevelled on their tips.

An additional object of the invention is to provide a plug-socket latching mechanism of the character described in which the components are watertight when connected to avoid potential problems caused by water leakage.

Yet another object of the invention is to provide a plug-socket latching mechanism of the character described which is constructed to function reliably over an extended operating life and which includes springs that are readily accessible for inspection and/or replacement.

A still further object of the invention is to provide, in a plug-socket latching mechanism of the character described, a socket that is suited to receive different types of plugs, including two-prong plugs, three-prong plugs, and polarized plugs. The socket can either be part of a wall mounted receptacle or it can be carried on one end of an extension cord.

Still another object of the invention is to provide a plug-socket latching mechanism of the character described which is constructed in a simple and economical manner and which may be used with virtually any type of electrical equipment, including stationary appliances and tools as well as portable appliances and tools.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
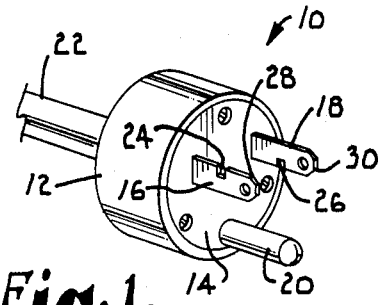
FIG. 1 is a perspective view of a conventional electrical plug in which the flat prongs have been modified somewhat in order to mate with the socket portion of a plug-socket arrangement constructed according to a preferred embodiment of the invention.

Referring now to the drawings in more detail and initially to FIG. 1, numeral 10 generally designates a male electrical plug which is conventional for the most part. The plug 10 includes a body 12 which may be of virtually any configuration but which is shown as cylindrical. The body 12 has a front face 14 from which two electrically conductive prongs 16 and 18 project. A third prong 20 projects from face 14 and serves as a ground prong. A cord 22 connects with the plug body 12 and contains a pair of conductor wires (not shown) that connect with the prongs 16 and 18. A third wire (not shown) contained within the cord 22 is a ground wire that connects with the ground prong 20.

As thus far described, the plug 10 is conventional. In accordance with the present invention, a rectangular notch 24 is formed in the upper edge of prong 16 and a similar rectangular notch 26 is formed in the lower edge of the other prong 18. The notches 24 and 26 are located approximately midway along the lengths of the prongs 16 and 18. The tip of prong 16 is bevelled at both corners, as indicated by numeral 28. The corners of the tip of prong 18 are similarly bevelled, as indicated by numeral 30.

Figure 2:
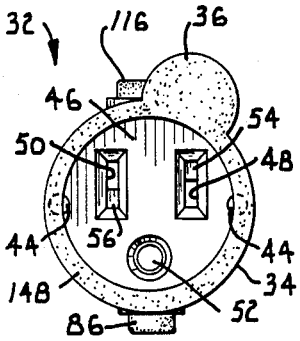
FIG. 2 is a front elevational view of a socket which mates with the plug shown in FIG. 1 in accordance with a preferred embodiment of the invention.
Figure 3:
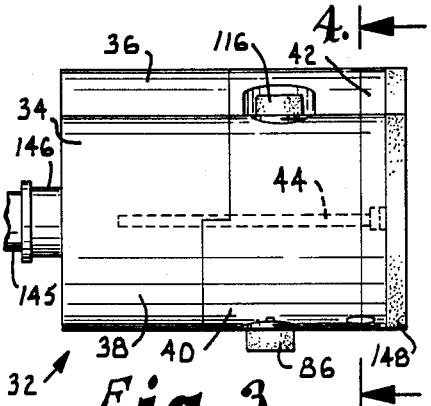
FIG. 3 is a side elevational view on an enlarged scale of the socket.

With particular reference to FIGS. 2 and 3, a female socket constructed in accordance with the present invention is generally identified by numeral 32. The socket 32 has a body 34 which may be of virtually any shape but which is illustrated as being generally cylindrical with a bulbous node 36 located on the top. The body 34 is formed by a pair of body sections 38 and 40 and by a face plate 42 which is secured to one end of section 40. A pair of screws 44 connect the body sections 38 and 40 together and also connect the face plate 42 such that it presents a flat front face 46 (FIG. 2) on the socket 32. As best shown in FIG. 2, a pair of spaced apart slots 48 and 50 extend into the face 46 and through the face plate 42. The slots 48 and 50 are located side by side and are arranged to closely receive the prongs 16 and 18, respectively. A round opening 52 is also formed in the face 46 at a location to receive the ground prong.

Figure 4:
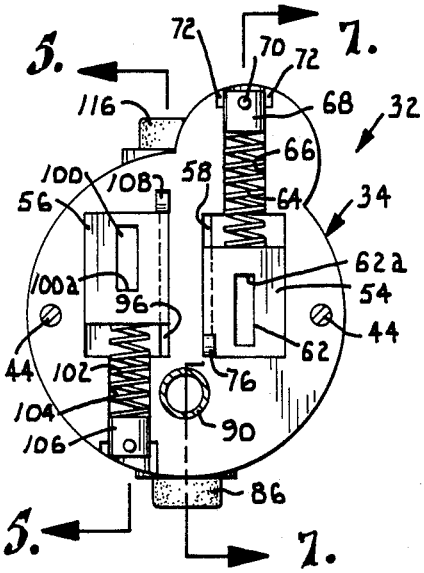
FIG. 4 is a sectional view on an enlarged scale taken generally along line 4—4 of FIG. 3 in the direction of the arrows.
Figure 7:
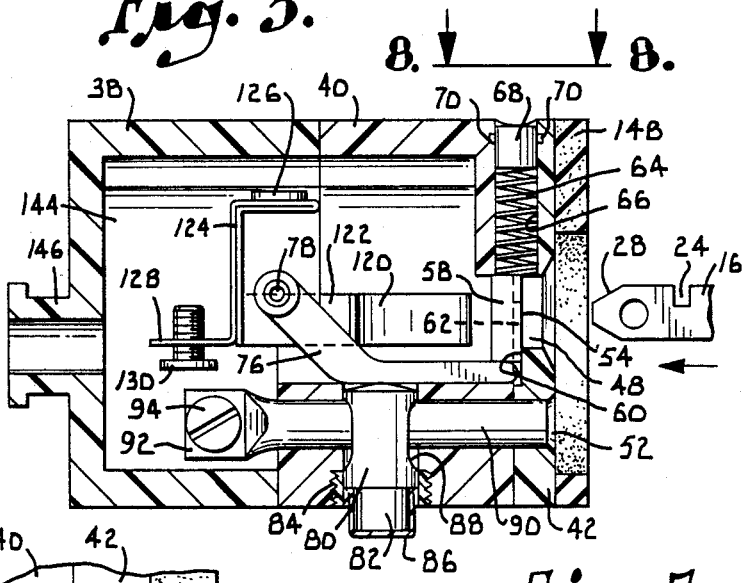
FIG. 7 is a sectional view taken generally along line 7—7 of FIG. 4 in the direction of the arrows, with one of the plug prongs shown in position to enter the mating slot.

The prongs 16 and 18 are latched in slots 48 and 50 by a pair of latching plates 54 and 56, respectively. As best shown in FIGS. 4 and 7, plate 54 is mounted behind slot 48 for up and down sliding movement against the back surface of the face plate 42. A flange 58 is turned rearwardly from one edge of plate 54 and is received in a mating groove 60 formed in the socket body 34. The fit of the flange 58 in groove 60 guides the movement of the latch plate 54 and restricts the latch plate to reciprocating up and down sliding movement. A slot 62 is formed through latch plate 54 and has the same size and shape as slot 48. A compression spring 64 mounted in a passage 66 acts at its bottom end against the top of plate 54 and at its top end against the underside of a removable plug 68. The spring 64 thus exerts a biasing force which continually urges plate 54 downwardly to the latching position shown in FIGS. 4 and 7. In this position, the slot 54 is out of alignment with slot 48. Plate 54 can be slid upwardly against the force of spring 64 until its slot 62 is in alignment with slot 48 in a release position, as will be explained more fully.

Figure 8:
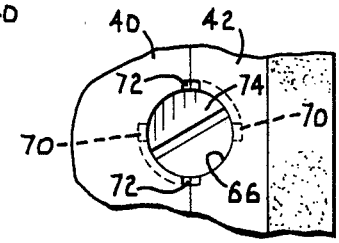
FIG. 8 is a fragmentary top plan view on an enlarged scale taken generally along line 8—8 of FIG. 7 in the direction of the arrows, with the broken lines showing the removable plug member rotated such that it can be removed from the socket body to provide access to the spring associated with the plug member.

As best shown in FIG. 8, the plug 68 has a pair of diametrically opposed pins 70 projecting from its opposite sides. The pins 70 normally secure the plug 68 in place in passage 66. However, plug 68 may be turned in passage 66 through an arc of approximately 90° such that the pins 70 come into alignment with grooves 72, and the grooves then receive the pins and allow the spring 64 to pop the plug 68 out of passage 66. This provides access to the spring 64 and permits it to be inspected and replaced if necessary. The plug 68 can be installed by pushing it downwardly into passage 66 with the pins 70 fitting in the grooves 72 and then turning the plug through a 90° arc to the position shown in FIG. 8. The pins 70 are then out of alignment with the grooves 72 and act to retain the plug in place. A slot 74 is provided in the top surface of plug 68 to allow it to be easily turned with a screw driver or other tool (not shown).

The latch plate 54 may be pushed upwardly against the force of spring 64 by an actuating mechanism which includes a bent lever arm 76 have one end pivotally connected within body 34 by a horizontal pivot pin 78. The opposite or free end of arm 76 is engaged against the bottom of the flange 58. The lower edge of arm 76 is engaged by a cylindrical barrel 80 which extends from a release button 82. The button 82 projects out through the bottom of the housing 34 through a fitting 84 which is threaded into the housing. A waterproof cover 86 covers the button 82 and seals it to the socket body 34 in a waterproof manner, thus preventing water from leaking past the button and into the housing.

When button 82 is depressed, the barrel 80 moves upwardly and pivots arm 76 in a counterclockwise direction (as viewed in FIG. 7) about the pivot pin 78. This causes the free end of arm 76 to move upwardly which in turn raises the latch plate 54 to its release position where the slot 62 is aligned with slot 48.

The barrel 80 is provided with an oval shaped passage 88 through which a metal tube 90 extends. The front of tube 90 fits closely inside of the ground opening 52 such that the ground prong 20 contacts tube 90 when inserted in opening 52. The back end of tube 90 is flattened to provide a terminal 92 into which a screw 94 is threaded. By virtue of the oval configuration of passage 88, barrel 80 is able to move upwardly and downwardly without obstruction from the tube 90 in order to pivot lever 76 as necessary to permit the latch plate 54 to slide between the latching and release positions.

Figure 5:
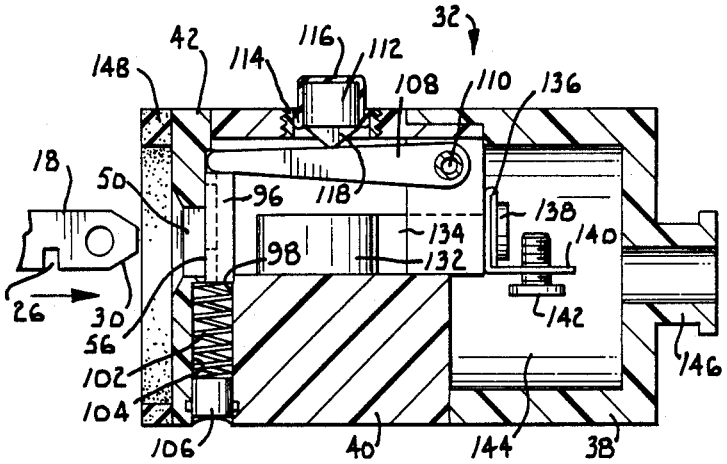
FIG. 5 is a sectional view taken generally along line 5—5 of FIG. 4 in the direction of the arrows, with one of the prongs of the male plug shown fragmentarily in position to enter the mating slot.
Figure 6:
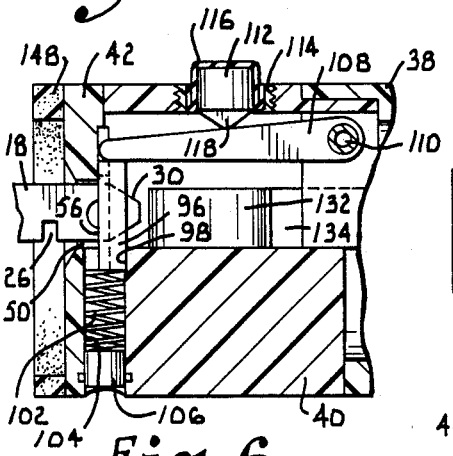
FIG. 6 is a fragmentary sectional view similar to FIG. 5, but showing the plug prong inserted partially into the mating slot.

As best shown in FIGS. 4–6, the other latch plate 56 is provided with a rearwardly turned flange 96 which fits in a mating groove 98 in order to restrict the latch plate 56 to reciprocating up and down sliding movement behind slot 50. A slot 100 which is formed through plate 56 has the same size and shape as slot 50.

A compression spring 102 acts against the bottom edge of latch plate 56 to normally urge it upwardly toward the latching position shown in FIGS. 4 and 5. In the latching position, slot 100 is out of alignment with slot 50. The spring 102 is fitted in a passage 104 and acts at its bottom end against a removable plug 106. The plug 106 may be removed in the same manner described in connection with plug 68 to provide access for inspection and/or replacement of spring 102.

Latch plate 56 is controlled by an actuating mechanism that includes a lever arm 108 which is pivotally pinned at its back end for movement about the axis of a horizontal pivot pin 110. The opposite or front end of lever 108 acts against the top edge of flange 96.

A release button 112 projects out through the top of the socket body 34 at a location adjacent to the node 36. Button 112 extends slidably through a fitting 114 which is threaded into the socket body. A waterproof cover 116 covers button 112 and provides a watertight seal between the button and the socket body 34 in order to prevent water from leaking into the socket body.

Button 112 has a conical tip 118 on its bottom end which acts against the top edge of arm 108. When button 112 is depressed as shown in FIG. 6, lever arm 108 is pivoted in a counterclockwise direction (as viewed in FIGS. 5 and 6), and this in turn pushes plate 56 downwardly to its release position wherein the slot 100 is aligned with slot 50.

As best shown in FIG. 7, slot 48 is provided with an electrical contact that is formed by a bent end portion 120 of an electrically conductive arm 122. The arm 122 is bent as indicated at 124 and secured to the socket body 34 by a screw 126 or another suitable fastener. The end of the bent arm provides a flat electrical terminal 128 into which a terminal screw 130 is threaded.

The other slot 50 is provided with a similar electrical contact which includes a bent end 132 (see FIG. 5) of a conductive arm 134. The arm 134 is bent at 136 and is secured to the socket body 34 by a screw 138 or other fastener. The end of the bent arm provides an electrical terminal 140 into which a terminal screw 142 is threaded.

The terminals 92, 128 and 140 are electrically isolated from one another and from the parts of the latch actuating mechanism. All of the terminals are located in a cavity 144 formed within the rear body section 38. A cord 145 (FIG. 3) can be inserted in the cavity 144 through a cylindrical hub 146 formed on the back of the rear body section 38. The two conductor wires in the cord can be secured to terminals 128 and 140 by looping the wire ends and tightening the screws 130 and 142 against the loops. The ground wire in the cord can be connected to the ground terminal 92 by tightening screw 94 against the looped end of the ground wire.

In use, the plug 10 can be plugged into the socket 32 in a conventional manner, and the prongs 16 and 18 will automatically be latched in place to hold the faces 14 and 46 against one another and to maintain the electrical connection provided by the plug and socket. With reference to FIGS. 5 and 6 in particular, as prong 18 enters slot 50, the lower bevel 30 on the tip of prong 18 acts against the bottom edge 100*a* (see FIG. 4) of slot 100 in the latch plate 56. The bevel 30 pushes latch plate 56 downwardly by camming action against the edge 100*a*, and this eventually forces latch plate 56 downwardly to the release position shown in FIG. 6. Then, the prong 18 can fully enter the slot 50 until the notch 26 comes into alignment with the slot edge 100*a*. At this time, spring 102 forces plate 56 upwardly such that the edge 100*a* fits closely in notch 26 and thereby latches prong 18 in slot 50.

At the same time, the other prong 16 enters the other slot 48, and the top bevel 62 on prong 16 acts in camming fashion against the upper edge 62*a* (see FIG. 4) of slot 62. This forces plate 54 to slide upwardly against the force of spring 64 until plate 54 reaches its release position wherein slot 62 is aligned with slot 48. Prong 16 can then fully enter slot 48 until the notch 24 is aligned with edge 62*a*, at which time spring 64 forces the latch plate 54 downwardly to engage the edge 62*a* in the notch 24. This latches prong 16 in the slot 48.

The latching mechanisms thereafter maintain prongs 16 and 18 in the latched condition, retains the plug 10 in face to face contact with the socket 32, and prevents the prongs from being pulled out of the slots due to pulling forces applied on the cord 22 or on the cord 145 that connects with the socket body 34.

When it is desired to detach the plug and socket, the socket body 34 is grasped in one hand, and the thumb and forefingers are used to depress the two buttons 82 and 112 simultaneously. The two latch plates 54 and 56 are then slid to the release positions such that the edges 62*a* and 100*a* are displaced from the notches 24 and 26, thus disengaging the latch plates from the prongs 16 and 18 and permitting the prongs to be removed from the slots 48 and 50. The other hand can be applied to the plug body 12 in order to pull the prongs out of the slots 48 and 50.

It is noted that the buttons 82 and 112 are located on the bottom and top of the socket body at diametrically opposed locations. Consequently, the socket body 34 can be conveniently gripped in one hand, and the two buttons 82 and 112 can easily be squeezed toward one another by the thumb and forefinger in order to simultaneously depress both buttons. This leaves the other hand free to pull on the plug body 12 to disconnect it from the socket body 34.

It is contemplated that, rather than being the female part of an extension cord, the socket 32 may be formed as part of a wall mounted receptacle to which a plug may be connected. In this instance, the release buttons should be located on the face of the receptacle in order to make them conveniently accessible when it is desired to release the plug. It is also contemplated that the latching mechanism may include latch elements that extend through openings formed in the plug prongs or simply applied pinching action to the plug prongs in order to latch them in the slots of the socket body. The latter arrangement has the advantage of avoiding even the minimal modification of the prongs that is required by the embodiment shown and described herein.

The waterproof covers 86 and 116 seal the button openings against the leakage of water. It is also preferred that the face plate 42 of the socket be provided with a gasket 148 which extends around the periphery of the face plate 46 as well as the node 36. The gasket 148 is squeezed against the perimeter of the plug face 14 when the plug is inserted into the socket, and the gasket then provides a waterproof joint between the plug and socket that prevents the leakage of water that could otherwise possibly leak into the plug-socket connection. By virtue of the waterproofing that is provided by the covers 86 and 116 and the gasket 148, the plug-socket of the present invention is particularly well suited for use by firefighters or in other situations where water is present.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A female electrical socket for receiving an electrical plug having a pair of electrically conductive prongs, said socket comprising:

a socket body having a face and a pair of slots in said face arranged to receive the prongs of the plug therein;

latch means in said socket body for releaseably latching the prongs in said slots, said latch means having a latching position wherein said latch means engages the prongs in a manner to retain the prongs in the slots and a release position wherein the prongs are released and may be withdrawn from the slots;

a pair of latch elements mounted in the socket body adjacent the respective slots for movement between latching and release positions, each latch element engaging the corresponding prong in the latching position to retain the prong in the slot and releasing from the corresponding prong in the release position to permit withdrawal of the prong from the slot;

a spring acting against each latch element in a manner urging it toward the latching position, each spring being yieldable to allow movement of the corresponding latch element to the release position;

a removable access plug for each spring;

means for mounting each access plug on the socket body in a manner allowing selective removal of the access plug therefrom, each spring being accessible when the corresponding access plug is removed from the socket box;

means in said slots for establishing electrical connection with said prongs when the prongs are inserted in the slots; and means accessible on the exterior of said socket body for selectively effecting the release position of said latching means.

2. The socket of claim 1, wherein said accessible means comprises a pair of release buttons mounted on said socket body at opposed locations thereon and means for effecting the release position of said latching means when both of said release buttons are depressed.

3. The socket of claim 1 including means for guiding each latch element along a linear path between the latching and release positions.

4. The socket of claim 1 wherein each prong has a notch in which the corresponding latch element is engaged in the latching position.

5. The socket of claim 4, wherein each latch element comprises a latch plate mounted for sliding movement between the latching and release positions, each plate having an edge portion engaged in the corresponding notch in the latching position.

6. The socket of claim 5, wherein:

each latch plate has a slot aligned with the corresponding slot in said socket body face in the release position and misaligned with the corresponding slot said socket body face in the latching position; and said edge portion of each latch plate is located at an end of the slot therein.

7. The socket of claim 5, including a beveled surface on each prong acting against said end of each slot to move the latch plate to the release position upon insertion of the prong in the slot, said yieldable means effecting movement of the latch plate to the latching position when the prong is fully inserted in the slot with said notch aligned with the latch plate.

8. The socket of claim 5, including a beveled surface on each prong acting against said edge portion of the latch plate to move the latch plate to the release position as the prong is entering the slot, said yieldable means effecting movement of the latch plate to the latching position when the prong is fully inserted in the slot with said notch aligned with the latch plate.

9. The socket of claim 1, wherein said accessible means comprises:

a button for each latch element, said buttons being mounted in opposition to one another on the exterior of said socket body and being depressable; and linkage means for connecting each button with the corresponding latch element in a manner to move the latter to the release position thereof upon depression of the corresponding button.

10. The socket of claim 9, wherein:

said linkage means comprises a lever arm for each latch element mounted in the socket body for pivotal movement about a pivot axis and acting against the corresponding latch element at a location remote from the pivot axis; and each button acts against the corresponding lever arm at a location offset from said pivot axis and in a manner to effect pivoting of the arm to move the latch element to the release position upon depression of the button.

11. The socket of claim 10, including:

a barrel extension on one of said buttons acting against the corresponding pivot arm;

an elongate ground contact extending in the socket body and connecting with a ground opening in the face of the socket body; and a passage through said barrel extension through which said ground contact extends, said passage being larger than said ground contact to allow the barrel extension to move without obstruction from the ground contact with said one button is depressed.

12. An electrical plug-socket arrangement comprising:

a male plug having a face and a pair of electrically conductive prongs projecting therefrom, each prong having a notch therein;

a female socket having a socket body presenting a face thereon and a pair of slots in said socket face arranged to receive said prongs when said plug and socket faces are positioned face to face;

a pair of electrical contacts in said socket body located to be contacted by the respective prongs upon insertion thereof into said slots, said contacts being electrically isolated from one another;

a pair of latch plates in said socket body mounted for sliding movement adjacent the respective slots between latching positions wherein the latch plates engage the corresponding prongs within the notches thereof to hold the prongs in the slots and release positions wherein the latch plates are disengaged from the prongs and removed from the notches to allow withdrawal of the prongs from the slots;

springs means urging each latch plate toward the latching position thereof;

a pair of opposing release buttons on said socket body; and linkage means linking each button to one of the latch plates to effect the release positions of the latch plates when the buttons are depressed.

13. The invention of claim 12, wherein said socket body has a generally cylindrical exterior surface and said buttons are situated at substantially diametrically opposed locations on said exterior surface of the socket body.

14. A female electrical socket for receiving an electrical plug having a pair of electrically conductive prongs each have a notch, said socket comprising:

a socket body having a face and a pair of slots in said face arranged to receive the prongs of the plug therein;

a pair of latch plates mounted in the socket body for sliding movement between latching and release positions, each latch plate having an edge engaged in the notch of the corresponding prong in the latching position to retain the prong in the slot and each plate releasing from the corresponding prong in the release position to permit withdrawal of the prong from the slot;

yieldable means for urging each latch plate toward the latching position;

means in said slots for establishing electrical connection with said prongs when the prongs are inserted in the slots; and means accessible on the exterior of said socket body for selectively effecting the release position of each latch plate.

* * * * *